United States Patent [19]

Richards

[11] 4,268,030

[45] May 19, 1981

[54] INFLATABLE ACTION TOY

[75] Inventor: Lawrence Richards, Glen Cove, N.Y.

[73] Assignee: GLJ Toy Co., Inc., Syosset, N.Y.

[21] Appl. No.: 956,659

[22] Filed: Nov. 1, 1978

[51] Int. Cl.[3] ..... A63B 69/34; A63H 15/06

[52] U.S. Cl. ..... 272/77; 46/87; 46/155

[58] Field of Search ..... 272/76, 77; 46/87, 88, 46/155

[56] References Cited

U.S. PATENT DOCUMENTS

| | | | |
|---|---|---|---|
| 1,567,132 | 12/1925 | Gill | 46/87 |
| 2,992,829 | 7/1961 | Hopkins | 273/157 A UX |
| 4,034,495 | 7/1977 | Lemelson | 46/87 X |

OTHER PUBLICATIONS

Sear's Christmas Catalog, 1974, p. 547.

*Primary Examiner*—Anton O. Oechsle

*Attorney, Agent, or Firm*—Lackenbach, Lilling & Siegel

[57] ABSTRACT

An inflatable toy is described, in the nature of a free-standing punching bag, which includes front and rear panels joined to each other to form a substantially sealed enclosure capable of retaining gas under pressure. An internal or intermediate panel is provided inside of the enclosure and is spaced substantially equally from the front and rear panels. The front and intermediate panels are formed of a transparent material while the rear panel is opaque. Images are imprinted on the internal surfaces of the three panels, the images cooperating with each other to produce an illusion of three dimensions and composite image which continuously changes with different angles of observation of the inflatable article.

4 Claims, 6 Drawing Figures

INFLATABLE ACTION TOY

BACKGROUND OF THE INVENTION

The present invention generally relates to inflatable structures, and particularly to inflatable toys and the like which generate an illusion of a three-dimensional image to an observer.

Toys of various types, including inflatable toys, which are imprinted with pictorial information are well known. For example, in U.S. Pat. No. 2,635,387 there is disclosed a toy balloon novelty. The disclosed arrangement includes a plurality of balloons, one disposed within the other, and arranged so that the balloons can be selectively or simultaneously inflated and used as a toy, for advertising, display and sales promotional purposes. The patentee suggests that different characters, animals and the like may be printed on the inner and outer balloons. However, the only object of the patented device is to provide one composite design which is pleasing or, in the case of advertising, informative.

A balloon world satellite is disclosed in U.S. Pat. No. 2,927,383. The device includes two concentric spheres having different diameters and mounted on a common shaft. The outer sphere is formed of a transparent material, while the inner sphere is imprinted with indicia or markings which represent the various countries, oceans or other portions of the world and is in the nature of a globe. A spherical satellite or object is movably mounted in the space between the concentric spheres and, when the outer sphere is rotated about its axis, the movable object is imparted an orbital motion about the inner sphere. The object of the invention is to provide a device which is educational and scientific principles or phenomena can be demonstrated and explained. However, as noted, imprinting or markings are only formed on the inner sphere, the outer sphere being transparent through its entire surface.

An inflatable display is disclosed in U.S. Pat. No. 3,026,648. One of the primary objects of the disclosed invention is to provide an inflatable article with a wall decoration which will not easily wear off or fade. A secondary object is to provide such wall decoration which is photographically produced and which is highlighted by ambient light. In this patent there is provided a front panel and a rear panel joined to form a sealed enclosure. The patentee discloses a photographic process which permits, for example, a portion of the front panel to be imparted with an illustration as part of the decoration scheme which does not easily fade or rub off. The patentee contends that by imparting the images on the front panel in accordance with his invention, removal of the design by scuffing, fading or discoloration is eliminated. The rear panel, in accordance with the patent, is advantageously formed of a light transmitting plastic which permits ambient light to pass completely through the resulting inflatable bag and illuminate or highlight the image imprinted on the front panel. However, only a single image is formed on the inflatable display and it does not form an illusion of three dimensions.

An inflatable toy is shown in an advertisement in the July 1973 issues of "Toys" Magazine. On this toy the front and rear panels are also joined to form a sealed enclosure, both panels being opaque or imprinted to make the panels opaque. A circular portion of the front panel is not imprinted and forms a transparent window in the likeness of a porthole in a ship which permits one to view the rear panel. An image or character is imprinted on the inside surface of the rear panel which can be viewed through the transparent window or porthole formed on the front panel. In effect, the window, which is transparent over its entire surface permits the image on the rear panel to be viewed but is not imprinted with any characters or information which cooperate with the character or image on the rear panel to form an illusion of three dimensions.

A recent U.S. Pat. No. 4,034,495 discloses an inflatable toy which includes spaced walls on which there is provided printed matter. The printed matter on the two walls provides interference effects which appear to change as the angle of sight of the observer of the inflatable assembly varies. However, this patent does not disclose the use of images or characters on panels which are spaced to each other to provide the illustion of three dimensions.

SUMMARY OF THE INVENTION

Accordingly, it is an object of the present invention to provide an inflatable article which differs in construction, operation and result from the prior art articles and devices.

It is another object of the present invention to provide an inflatable article in the nature of a toy which is simple in construction and inexpensive to manufacture.

It is still another object of the present invention to provide an inflatable article which includes two or more panels spaced from each other when the article is inflated, with each of the panels being imprinted with images or characters which cooperate with each other to produce the illusion of three dimensions and an image which continuously changes with different angles of observation of the inflatable article.

It is yet another object of the present invention to provide an inflatable article which is attractive and eye-catching.

It is a further object of the present invention to provide an inflatable article imprinted with images in a manner to reduce fade and eliminate wear with use.

In order to achieve the above objects, as well as others which will become apparent hereafter, an inflatable article in accordance with the present invention comprises first and second panels made substantially of flexible sheet material and sealingly joined to each other at their respective peripheral edges to form a substantially sealed enclosure capable of retaining gas under pressure. Said first and second panels have respective first and second panel portions spaced from each other when said enclosure is internally gas pressurized. Said first panel portion is transparent to cause said second panel portion to be visible therethrough. Said first panel portion is partially imprinted with a first image to permit continued visibility of said second panel portion. The second image is imprinted on said second panel portion, said first and second images cooperating with each other to produce an illusion of three dimensions and an image which continuously changes with different angles of observation of the inflatable article.

In the presently preferred embodiment, the front panel is formed of a transparent material while the rear panel is formed of an opaque material, the images being imprinted on the respective surfaces thereof interiorly of the enclosure.

In the presently preferred embodiment, there is further provided an intermediate panel between said first and second panels, said intermediate panels being spaced from said first and second panels when said enclosure is internally gas pressurized. Said intermediate panel has a transparent panel portion imprinted with a third image to permit continued visibility of said second image therethrough and through said first panel portion. Said first, second and third images cooperating with each other to produce an illusion of three dimensions and an image which continuously changes with different angles of observation of the inflatable article.

BRIEF DESCRIPTION OF THE DRAWINGS

Further advantages of the invention will become apparent from a reading of the following specification describing an illustrative embodiment of the invention. The specification is to be taken with the accompanying drawings in which.

DESCRIPTION OF THE PREFERRED EMBODIMENT

Figure 1:
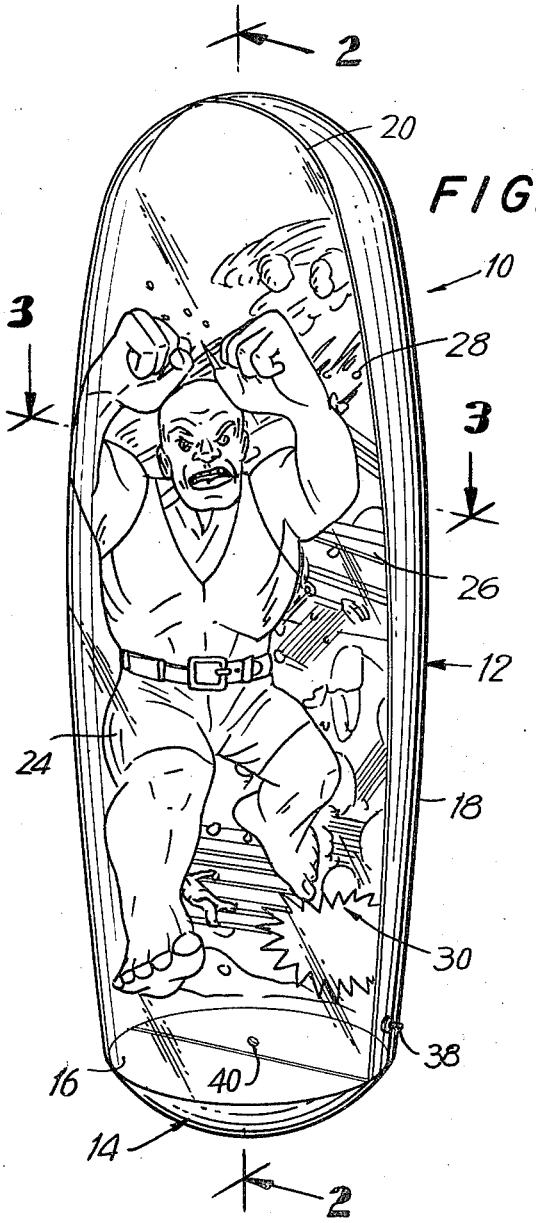
FIG. 1 is a perspective view of an inflatable article in the nature of a free standing punching bag in accordance with the present invention.
Figure 2:
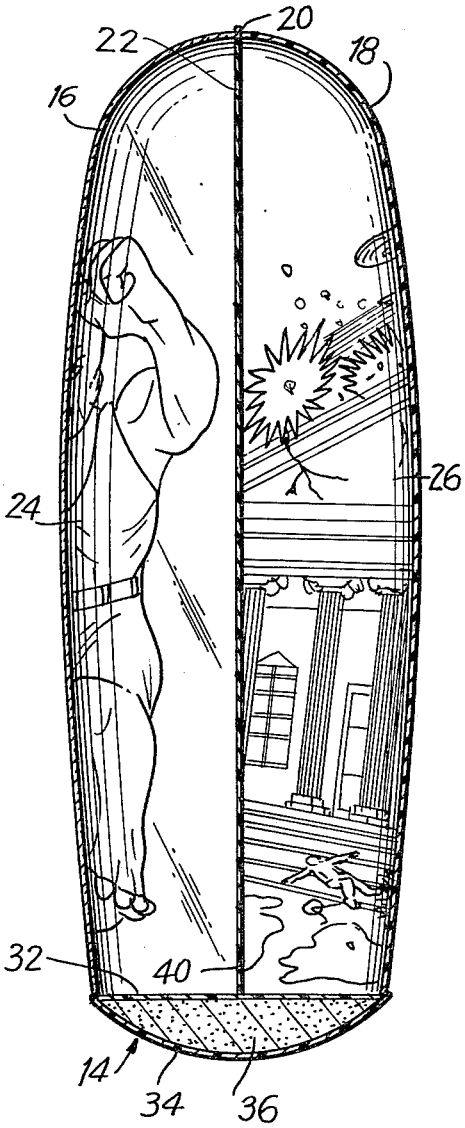
FIG. 2 is a cross-sectional view of the inflatable article shown in FIG. 1, taken along line 2—2.
Figure 3:
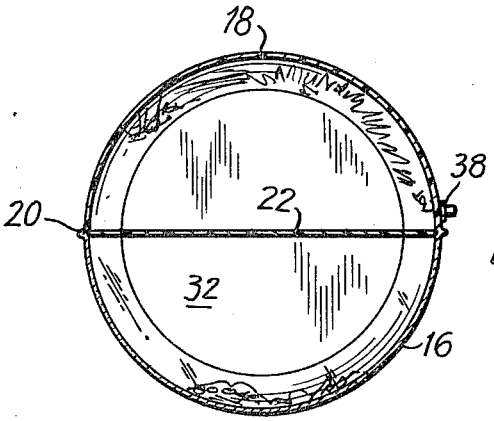
FIG. 3 is a cross-sectional view of the inflatable article shown in FIG. 1, taken along line 3—3.

Referring specifically to the figures, in which identical or similar parts are designated by the same reference numerals throughout, and first referring to FIGS. 1–3, an inflatable article or action toy is shown and generally designated by the reference numeral 10.

While the embodiment to be described is in the nature of a free-standing punching bag, it should be evident that the present invention can be used in conjunction with any other type of inflatable article or toy.

The toy 10 includes an inflated upper portion 12 and a weighed base 14 as shown.

Figure 5:
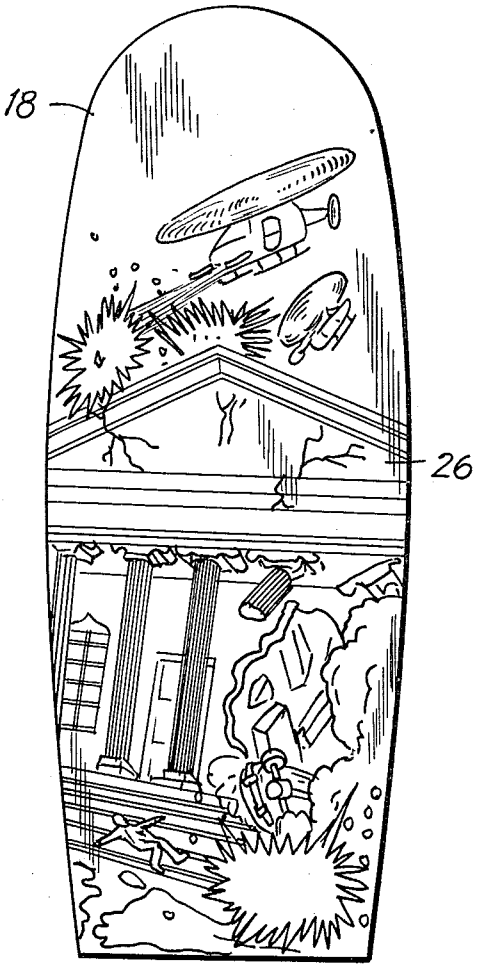
Figure 4:
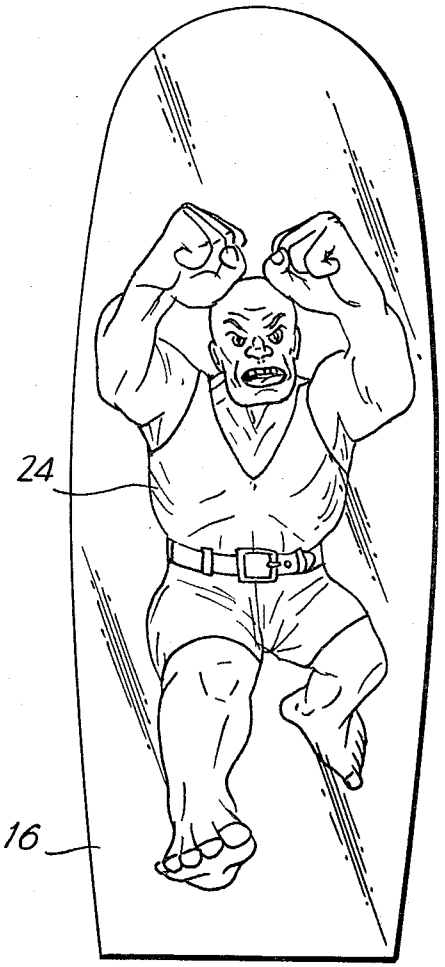

The inflated upper portion 12 includes a front panel 16, shown separately in FIG. 4, and a rear panel 18, separately shown in FIG. 5. The panels 16, 18 may be made of substantially flexible sheet material, such as vinyl, or any other such materials commonly used for the making of inflatable toys. The panels 16, 18 are sealingly joined to each other at their respective peripheral edges to form a seam 20. The panels thereby form a substantially sealed enclosure capable of retaining gas under pressure.

Figure 6:
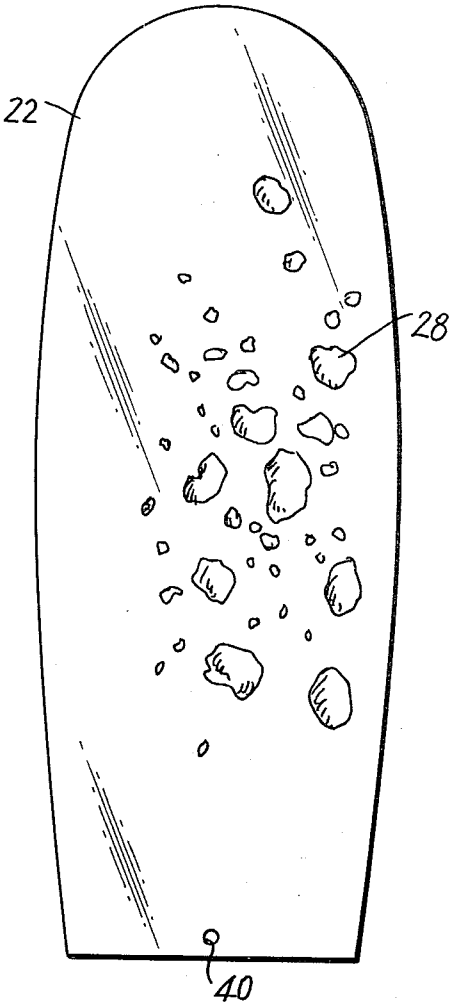
FIGS. 4–6 are front elevational views of the front, rear and intermediate panels respectively forming the inflatable article shown in FIGS. 1–3.

In the presently preferred embodiment, there is also provided an optional middle, central or intermediate panel 22, separately shown in FIG. 6. The intermediate panel is disposed between the front panel 16 and the rear panel 18, as best shown in FIGS. 2 and 3.

To achieve the optimum advantages of the present invention, the front panel 16 and the rear panel 18 must include panel portions which are spaced from each other when the enclosure is internally gas pressurized. In the construction shown, the substantial portions of the front and rear panels are spaced from each other when the toy is pressurized except, of course, at the seam 20.

The front panel portion which is spaced from the rear panel must be transparent to cause the panel portion on the rear panel to be visible therethrough. In the presently preferred embodiment, the entire front panel is made of a transparent material so that the entire rear panel can be viewed therethrough.

The front panel portion which is spaced from the rear panel is partially imprinted with a first image 24 to permit continued visibility of the panel portion on the rear panel. A second image 26 is imprinted on the rear panel portion spaced from the front panel, the images on the respective front and rear panel portions cooperating with each other to produce an illusion of three dimensions and an image which continuously changes with different angles of observation of the inflatable article. In the embodiment being described, the image is in the nature of a human character, while the rear image 26 is of a building structure.

When the intermediate panel 22 is used, as in the disclosed embodiment, it is spaced from the front and rear panels 16, 18 respectively when the enclosure is internally gas pressurized. In the presently preferred embodiment, the entire intermediate panel is made of a transparent sheet material. However, in order to practice the invention it is only necessary that the intermediate panel 22 have a transparent panel portion imprinted with an image 28 to permit continued visibility of the image 26 on the rear panel 18 therethrough and through the front panel 16. Now, the images 24, 26 and 28 cooperate with each other to produce an illusion of three dimensions and an image which continuously changes with different angles of observation of the inflatable article.

It should be evident from FIGS. 1–3, the intermediate panel 22 is generally parallel and coextensive with the front and rear panels 16, 18. However, the intermediate panel 22 may be shorter or smaller than the front and rear panels and may be positioned between the two panels or suspended therebetween in any conventional or desired manner. Also, while the intermediate panel 22 is shown to be substantially equally spaced between the front and rear panels, this likewise is not a critical feature of the present invention and the intermediate panel may be spaced closer to the front or rear panel with different degrees of advantage and to slightly modify the three-dimensional illusion which is obtained.

The image 28 on the intermediate panel 22 is shown to be in the nature of rocks or stones which are falling or are propelled through the air. With the three spaced panels imprinted with the images shown, the three-dimensional illusion is given that the stones are falling or have been propelled from the region of the building structure 26 which is disposed behind the image of the character 24. As noted before, the resulting three-dimensional illusion, generally designated by the reference numeral 30 is in the nature of a composite image which continuously changes with different angles of observation of the inflatable article 10.

The weighed base 14, referring to FIG. 2, includes a covering panel 32, a bottom panel 34 joined to the panel 32 to form a substantially closed space filled with a weight 36 of any suitable or desired type. The weighed base is provided with a rounded undersurface as shown and is so disposed with respect to the center of gravity of the toy 10 that when the punching bag is hit, it momentarily deflects but soon returns to its stable, generally vertical orientation as shown.

A valve 38 is provided as shown in FIGS. 1 and 3 and, when an intermediate panel 22 is used as shown, there is provided a hole 40 in the panel 22 to permit the gas pressure to equalize on both sides of the intermediate panels to thereby inflate the entire toy. If the intermediate panel is smaller than the front and rear panels, other spaces or openings may be provided to permit equalization of pressure on the two sides thereof.

Conventional decorative inflatable toys, when decorated with silkscreen or rotogravure designs, are colorful but often very flat and unattractive means of decorating and frequently have a tendency to fade and wear off with use due to the fact that they are only surface coatings. As a result, the inflatable toys soon lose their attractive appearance. Another feature of the present invention is that the front and rear panels are imprinted with images on the inside surfaces thereof to thereby dispose the images interiorly of the enclosure and protect these images 24, 26 and prevent the same from being removed from the respective panels by repeated handling thereof or contact therewith. Since the entire panel 22 is positioned interiorly of the enclosure, it does not, of course, make any difference on which side it is imprinted. By decorating the panels in this manner, the front viewing surface being clear vinyl, a brightly decorated inflatable toy results that resists fading and wear, and discoloration. This, as noted, is effected by utilizing a construction which uses flexible plastic sheet material, one or more surfaces of which are clear, and reverse printing on the interior wall surfaces thereof.

Thus, in addition to producing a toy which is attractive and eye-catching by producing an illusion of three dimensions, the toy of the present invention creates a surface decoration that will not abrade, wear, fade or discolor.

It is understood that the foregoing description of the embodiment illustrated herein is exemplary and various modifications to the embodiment shown herein may be made without departing from the spirit and scope of the invention.

What is claimed is:

1. An inflatable article comprising first and second panels made substantially of flexible sheet material and sealingly joined to each other at their respective peripheral edges to form a substantially sealed enclosure capable of retaining gas under pressure, said first and second panels having respective first and second panel portions spaced from each other when said enclosure is internally gas pressurized, said first panel portion being transparent to cause said second panel portion to be visible therethrough, said first panel portion being partially imprinted with a first image to permit continued visibility of said second panel portion, a second image being imprinted on said second panel portion, and an intermediate panel between said first and second panels, said intermediate panel being spaced from said first and second panels when said enclosure is internally gas pressurized, said intermediate panel having a transparent panel portion imprinted with a third image to permit continued visibility of said second image therethrough and through said first panel portion, said first, second and third images cooperating with each other to produce an illusion of three dimensions and an image which continuously changes with different angles of observation of the inflatable article.

2. An inflatable article as claimed in claim 1, wherein said intermediate panel in its entirety is formed of a transparent material.

3. An inflatable article as claimed in claim 1, wherein said intermediate panel is generally parallel and coextensive with said first and second panels.

4. An inflatable article as claimed in claim 1, wherein said intermediate panel is substantially equally spaced between said first and second panels.

* * * * *